US005846072A

United States Patent [19]

Willis

[11] Patent Number: 5,846,072

[45] Date of Patent: Dec. 8, 1998

[54] INDIRECT-FIRED, ALL CERAMIC PYROCHEMICAL REACTOR

[75] Inventor: H. Earl Willis, Spring, Tex.

[73] Assignee: Merichem Company, Houston, Tex.

[21] Appl. No.: 648,354

[22] Filed: May 14, 1996

Related U.S. Application Data

[63] Continuation-in-part of Ser. No. 308,658, Sep. 19, 1994, abandoned.

[51] Int. Cl.[6] ..... F27B 7/00

[52] U.S. Cl. ..... 432/31; 110/257; 110/229; 422/135; 422/137; 422/232; 432/124

[58] Field of Search ..... 110/227–229, 257, 110/258, 346; 432/31, 124, 107; 422/135, 137, 232, 233

[56] References Cited

U.S. PATENT DOCUMENTS

| | | | |
|---|---|---|---|
| 3,780,676 | 12/1973 | Hazzard et al. . | |
| 4,084,521 | 4/1978 | Herbold et al. . | |
| 4,398,471 | 8/1983 | Thomanetz | 110/258 X |
| 4,520,002 | 5/1985 | Willis, Jr. . | |
| 5,411,714 | 5/1995 | Wu et al. | 110/229 X |

*Primary Examiner*—Henry A. Bennett
*Assistant Examiner*—Susanne C. Tinker
*Attorney, Agent, or Firm*—Pravel, Hewitt, Kimball & Krieger

[57] ABSTRACT

The present invention is directed to an indirect-fired, stationary tube, gas/solids or solids/solids, full ceramic pyroprocessing furnace-reactor that uses heat-resistant conveyors to propel solids through the stationary tube.

19 Claims, 5 Drawing Sheets

INDIRECT-FIRED, ALL CERAMIC PYROCHEMICAL REACTOR

RELATED APPLICATIONS

This is a Continuation-in-Part of prior U.S. patent application Ser. No. 08/308,658 filed Sep. 19, 1994 now abandoned.

FIELD OF THE INVENTION

This invention is directed to indirect-fired pyrochemical reactors and methods of conducting chemical reactions with such apparatuses.

BACKGROUND OF THE INVENTION

Many beneficial chemical processes involving the heating of solids to high temperatures to produce chemical change require inputs of large amounts of energy to drive the desired reactions. When temperatures required for reaction are above the usable limits for ordinary metals such as carbon steel or stainless steel, the processing equipment must be more complicated, and operational feasibility is limited by the properties of available alternative materials. Examples of pyroprocess operations above stainless steel's 1000°–1800° F. maximum service temperature limit include: production of portland cement; production of lime; roasting and/or reduction of metal ores; and, as detailed in U.S. Pat. No. 4,520,002, the reduction of calcium sulfate using vaporous elemental sulfur.

Some of these processes, such as the production of lime by thermal decomposition of limestone ($CaCO_3 \rightarrow CaO + CO_2$), have been known and practiced for centuries. According to Boynton, *Chemistry and Technology of Lime and Limestone*, New York: Wiley—Interscience (1980), the thermal decomposition of limestone to make "quicklime" (CaO) is one of the most ancient of industrial processes, going back at least as far as 350 B.C. when Zenophon wrote about a shipwreck near Marseilles involving cargoes of linen and lime "for its bleaching." It might be supposed that by now the industry has matured to the point where any improvements can be only incremental, with only slight economic advantages to be won. Such supposition would be incorrect. To quote Boynton:

> "This is probably the most basic and apparently the simplest of all chemical reactions. But although it is theoretically prosaic (many erudite chemists are even disdainful of it because it is so elementary), there are many complexities attendant to this reaction. In spite of incontrovertible scientific data delineating calcination, this process still remains to some extent a technique or art that only an experienced lime burner fully comprehends. The numerous variables require trial and error methods for optimum performance and delicate empirical (often impulsive) modifications for operating efficiency."

In addition to such physical and chemical problems, a lime burner is faced with unavoidable compromises in selection of equipment for the process, since no single approach has been found most advantageous for all applications.

There have been many refinements in equipment used for lime production and other solid reaction operations, and yet, no single type of device has been found to be most advantageous in even a majority of pyroprocesses. Instead, different kinds of devices, each with its own advantages and disadvantages, must be considered in light of current technology and the particular problems associated with each application. Various approaches fit only a single set of circumstances in which they are most efficient; while others may be of use in a wide variety of situations. Very high temperature applications, such as the aforementioned sulfur reduction of calcium sulfate, raise requirements that are not satisfactorily met by available equipment.

Pyroprocessing devices are generally classified according to: (a) the condition in which the solids bed exists; (b) mechanisms of heat transfer; and (c) the method by which gas-solid contact is achieved. McCormick, Lucas, and Wells (1963: *Perry's Chemical Engineers' Handbook*, Perry, Chilton, and Kirkpatrick; New York: McGraw-Hill; 20–3.) define four conditions of solids beds: "Static" (no relative motion among solids particles); "Moving" (particles are separated enough to flow over each other); "Fluidized" (solids and gases are mixed together into a single phase which behaves as a boiling fluid); and "Dilute" (solids particles are so widely dispersed that they exert little influence on each other). Heat transfer modes are "direct" (flame, radiation, and/or combustion gases directly contact the solids) and "indirect" (other mechanisms). Gas-solid contact is achieved by use of countercurrent gas flow, concurrent gas flow, and/or crossflow of gas.

Large-scale, high temperature, gas-solid reaction operations are generally carried out commercially in moving bed vessels called kilns, but fluidized beds and/or dilute solids phases are also used in some cases. Certain processes can utilize indirect heating, but most large-scale pyroprocesses are based on direct heating. Equipment and techniques are widely available using various modes of gas flow and solids contacting. However, each approach has its own advantages and disadvantages.

With reference to lime production, again from Boynton, all of the following types of kilns have been used in modern times for production of lime:

Vertical

1. Traditional shaft types
2. Indirect gas-fired (producer gas)
3. Large capacity gas fired center burners, etc.
4. Large capacity mixed feed
5. Parallel-flow regenerative
6. Double-inclined
8. Annular (ring)

Rotary

1. Conventional types
2. Modern, modified types with
   a. Coolers
   b. Preheaters
   c. Internals (heat exchangers, dams, lifters)

Miscellaneous

1. Fluo-solids
2. Rotary hearth with travelling grate (Calcimatic)
3. Flash calciner
4. Horizontal Ring (Hoffman)

For the production of lime, Boynton describes in detail the principles, advantages, and problems with each type of calciner. To summarize, the vertical kilns have an edge in energy, with the highest efficiency on record (85%, or 3.03 MMBTU/ton lime) being achieved in a German mixed feed vertical kiln. However, vertical kilns can use only a relatively large-sized limestone, and this requires a longer calcination time and/or there is some unreacted stone ("core") remaining in the product. Another problem is the build-up of more undersize stone ("spalls") than can be profitably sold. Vertical kilns are also much less flexible as to the fuels which they can use, as each must be more or less specifically designed for the particular fuel that is to be fired. Rotary kilns have poorer thermal efficiencies (about 35%, or 8.50 MMBTU/ton lime for conventional kilns; about 50%, or 5.90 MMBTU/ton lime with full heat recuperation equipment included), but they can use (and switch between) practically any fuel, and the smaller stone that can be processed (0.25" to about 2.5") allows both lower holdup and more complete dissociation. However, the gradation of the kiln feed is critical to rotary operation, with superior quality and uniformity being obtained by the closest sizing—which, of course, must be balanced against the increased cost of stone classification. Kilns in the Miscellaneous category have been developed mainly to process certain sizes and gradations of stone. The Fluo-Solids kiln of the Fuller Company efficiently calcines (about 5.0 MBTU/ton CaO) very small particles, but it requires a finely classified feed at No. 8 to No. 65 mesh (2.38–0.23 mm) that is prohibitively expensive with most hard limestones. The Calcimatic kiln can handle a wide range of different types of stone since calcination time and temperatures can be closely controlled; however, fuel consumption (6.34 MMBTU/ton) has been disappointing. Flash calcining, wherein fuel is burned within a dispersed solids/gas phase, is useful for efficient dissociation of limestone fines (4.0=5.0 MMBTU/ton CaO) but products are of inferior quality and must be either hydrated or pelletized. The Hoffman tunnel-type kiln was invented in 1865, and it has been used increasingly less since about 1925 due to its very high hand-labor requirements.

Vertical kilns, including hundreds of modifications, are the most widely employed world-wide, but rotary kilns account for more than 88% of the commercial lime made in the U.S. This probably reflects the fact that energy has been less expensive in the U.S., as well as a requirement for much higher capital investment in the case of the rotary kiln. It can be seen that, due to changing conditions such as increased energy costs, environmental considerations and so on, there is a developing need to fully re-equip the lime industry over the next generation.

It should be noted that the indirect-fired vertical kiln listed above is indirect-fired only in the sense that the fuel is burned in an external chamber before the hot combustion gases are brought into the kiln. None of the methods discussed for lime production is actually indirect-fired in the sense that the hot combustion gas is kept from direct contact with the limestone. This assures that all of the current commercial approaches suffer (to a greater or lesser degree) from dust problems. Furthermore, it assures that attempts to recover high-temperature energy from the kiln exit gases are greatly complicated, if not economically precluded. For instance, the use of such dust-laden gases in boilers for co-generation of electrical power would cause short on-stream times and/or very poor (and greatly varying) heat transfer coefficients that could make both capital and operating costs so high as to be uneconomical.

There are some potentially beneficial applications for which no available equipment is very satisfactory, and thus, for which there has long been a need to develop alternative devices incorporating methods, materials, or techniques to overcome or eliminate specific problems in each. An analysis of the problems involved in carrying out the sulfur reduction of phosphogypsum in standard equipment is illustrative of disadvantages which must be overcome.

Phosphogypsum (calcium sulfate hemihydrate or dihydrate) is produced as an environmentally hazardous waste byproduct that contains almost all of the very large and increasingly expensive volume of sulfur consumed in the manufacture of phosphoric acid fertilizers. It is in the form of fine crystals that are contaminated with acids as well as with unreacted phosphate rock and impurities brought in with the rock.

The few successful commercial attempts to dispose of this phosphogypsum byproduct by converting it to useful products have been based on the Kuhne Process, which uses carbon (from coke or coal) to reduce part of the calcium sulfate to calcium sulfide, and then reacts the resulting mixture together with added clays, silicates, etc. to produce portland cement and sulfur dioxide. The sulfur recycle loop is closed by making the sulfur dioxide into sulfuric acid and using it to digest raw phosphate rock as a part of the fertilizer making process.

The Kuhne Process is technologically difficult and expensive to operate. It has been economically viable only in situations where sulfur was very expensive and/or in short supply. Since phosphate fertilizer costs are included in the price of food stuffs, and in view of the environmental considerations, a more economical way to recycle the phosphogypsum byproduct waste material is a desirable goal.

Trautz, Patentschrift No. 356414, and Horn, U.S. Pat. No. 2,425,740, have shown that sulfur can be used as well as carbon in the reduction of calcium sulfate by the following sequence of reactions:

$$CaSO_4+S_2 \rightarrow CaS+2SO_2, \text{ and} \quad (1)$$

$$3CaSO_4+CaS \rightarrow 4CaO+4SO_2. \quad (2)$$

A process based on these reactions would have some significant advantages over the Kuhne type of carbon-based reduction processes, such as being able to produce a stronger product gas—rich enough (over 10%, $SO_2$) to be used in a standard sulfur-burning sulfuric acid plant. This is because the gas produced in the first reaction is a desirable product, $SO_2$, instead of a diluent waste, $CO_2$. Although it is not yet necessary to treat gaseous wastes for removal of $CO_2$, production of $SO_2$ as a product gas is a significant economic advantage in that much smaller, less costly equipment is required for a given $CaSO_4$ throughput capacity. There are also other savings, such as reduced power consumption.

Even though the Trautz chemistry has been known for over 70 years, and the Horn patent issued over 40 years ago, there has been no known commercialization of a process for recovery of sulfur values from a phosphogypsum waste byproduct based on the reductive reaction of calcium sulfate with elemental sulfur.

The difficulties associated with maintaining effective contact between sulfur, which at the necessary reaction temperature is a gas, and solid calcium sulfate, so that reaction will occur at practical rates in a kiln or other vessel, have in all probability been the prime factor discouraging development of a sulfur value recovery process based upon the laboratory reaction disclosed by Trautz. Horn, in an attempt to develop a commercial process from such reactions, found that a minimum temperature of 2400° F. (1316° C.) was required for adequate reaction rates and that excess air had to be employed. Horn's disclosure, which teaches the requirement for high temperatures, establishes that the Trautz reaction is not practically adaptable to a commercial process unless some means are found to achieve adequate conversions at lower temperatures.

Willis, U.S. Pat. No. 4,520,002 disclosed a method for preparing elemental sulfur as a coherent diffusion resistant gas for a complete reaction with solid reactants at high temperatures. Such coherent diffusion resistant sulfur gas is particularly desirable for reacting with calcium sulfate in a rotating kiln. A process is described in which sulfur reacts with phosphogypsum according to Trautz chemistry at a temperature of at least about 1832° F. and higher in standard horizontal rotating kilns, which may be either direct-fired or indirect-fired.

While a process as described in U.S. Pat. No. 4,502,002 is workable and economically viable, there are problems with using phosphogypsum in rotating kilns. Dehydrated phosphogypsum, when heated to dark red heat (about 1201°–1382° F.) and above, tends to stick to the kiln walls and to agglomerate into balls, rings, etc. Although the agglomeration is weak (material can be knocked loose from the walls with only a slight tap on the outside of the kiln shell), it nevertheless creates a resistance to flow which interferes with steady delivery of solids into the reaction zone at proper temperature, resulting in reduced efficiency in reaction of those solids with sulfur, even when the sulfur has been prepared in a diffusion resistant gas form according to the above cited patent.

Direct-fired rotating kilns, especially those operating at high temperatures, have relatively low energy efficiencies. This is primarily due to three factors: (1) the necessity to suspend the kiln on bearings for rotation makes weight a consideration that limits the amount of insulating brickworks which can be included; (2) combustion gases become mixed with reaction product gases, hence increasing the gas volume which must be processed in subsequent steps; and (3) dust, acids, and other contaminants are picked up with the product and combustion gases which leave the kiln at relatively high temperatures, interfering with energy recovery from that very large volume of gases. Also, rotating kilns must have seals which, particularly on large, negative pressure kilns, are not completely effective in preventing air from being drawn into the reaction zone. Unless leakage can be kept to a minimum, the sulfur ignites as it debouches from its delivery conduit disrupting the cohesiveness of the prepared sulfur and scattering it into the gas phase. Although the product of the combustion side reaction is $SO_2$—the desired product—and extra sulfur can be added to compensate for that which is burned, reaction efficiency between the sulfur and the solids is reduced due to the lack of concentrated contact.

Unfortunately, the process of reducing calcium sulfate with sulfur does not adapt readily to other types of standard pyroprocessing equipment. Because the process requires both a solid-gas contact (equation 1—$CaSO_4(s)+S_2(g) \rightarrow CaS(s)+2SO_2(g)$) and simultaneously solids-solids contact (equation 2—$3CaSO_4(s)+CaS(s) \rightarrow 4CaO(s)+4SO_2(g)$), neither fixed beds (immobile particles) nor fluidized beds (particles separated from contact by gas) nor even dilute phase (particles separated from contact by gas and space) are suitable for that reaction.

Some such equipment might be used to carry out the reaction between sulfur and calcium sulfate, and then the mix could be dropped into a rotating kiln for finishing. This would be an improvement since high-strength $SO_2$ would be produced. However, unless a truly indirect-fired kiln (i.e., one in which the combustion gases do not contact the solids) could be used, the process would still suffer from the relatively poor energy efficiency associated with direct-fired rotating kilns. Again unfortunately, no material has been found practical for construction of large-scale, indirect-fired kilns operating at the high temperatures and with the corrosive atmospheres that are involved in this process. Although known to be desirable, as yet no equipment has been developed that is reliable and efficient for the sulfur reduction of phosphogypsum to calcium oxide and sulfur dioxide.

There has long been a need for an effective and efficient production-scale indirect-fired reactor which can be operated at high temperatures. There has long been a need for such a reactor in which reaction products and gases are not contaminated by combustion gases. There has long been a need for such a reactor having a device for moving solid reactants in a relatively hot reaction zone. There has long been a need for such a reactor that provides a relatively quiescent atmosphere in which reactions can occur.

SUMMARY OF THE INVENTION

The present invention is directed to an indirect-fired, stationary tube, gas/solids or solids/solids pyroprocessing furnace-reactor that uses heat-resistant conveyors to propel solids through the stationary tube. Except for the outer steel shell of the furnace, the machine can be constructed entirely from non-metallic parts. It can be built on the large scales required for commercial applications, using either countercurrent or concurrent gas flow with or without crossflow, and can be made capable of operation at temperatures in excess of 3000° F. The stationary tube design allows convenient and precise access for injection of gases into reaction zones at any point along the tube length. Stationary furnace walls whose insulating thicknesses are not limited by weight considerations, along with the possibility of energy recovery from clean exit gases allow very high overall energy efficiencies using modern steam generation equipment.

With a pyroprocessing furnace-reactor of this invention it is now possible to cleanly process a variety of solid reactants at temperatures exceeding about 1800° F. in an economical manner. Examples of such solid reactants include mineral ores such as Anatase, Bauxite, Borax, Calcite, Chalcopyrites, Chromite, Hematite and others; metallic halides such as calcium bromide, calcium chloride, calcium fluoride, calcium iodide, and similar ferric, ferrous potassium and sodium halides and the like; metallic carbides and metallic carbonates such as calcium carbonate and the like; metallic oxides such as chromites; metallic phosphates such as calcium phosphate; metallic sulfides and metallic sulfates such as calcium sulfate and the like. Further it is now possible to treat such solid reactants at temperatures of 1800° F. and higher in the presence of a medium of corrosive gases or other fluids which can only be withstood by ceramic parts that are points of contact with such solid reactants and corrosive gases and fluids.

Utilizing the above invention, some pyroprocessing operations which are now carried out in direct-fired rotary kilns, for example that of lime production, may be more economical due to energy savings and other benefits of the reactor design of this invention. Other processes that are not now feasible, such as the sulfur reduction of phosphogypsum, can be brought into commercial operation.

In one embodiment of a reactor according to the present invention, a tube (or tubes) made from a refractory material having a high thermal conductivity (e.g. but not limited to graphite, pure dense MgO, or pure dense alumina) is positioned within a reactor vessel so that a solid reactant may be transmitted into the tube and moved through it by a screw conveyer which is composed of heat-resistant materials, e.g. a refractory of low thermal conductivity, which can withstand the temperatures encountered in the reactor vessel and which is not affected by reactions occurring within the tube.

An injection device is provided for introducing other solid reactants or fluid reactants into the tube. An exit port or ports are provided for removing products and by-products of reactions occurring within the tube. A motor or other power source rotates the screw conveyer. A heat source is provided in the reactor vessel exteriorly of the tube for indirectly heating the materials inside the tube.

In one particular embodiment, such an apparatus is useful for the reduction of gypsum by elemental sulfur in the form of a concentrated, coherent, diffusion-resistant gaseous reagent (See U.S. Pat. No. 4,520,002) to recover, as $SO_2$, the sulfur values present in gypsum, with the concurrent production of lime. In this embodiment, dehydrated gypsum ($CaSO_4$) is continuously fed into a tube (preferably made from high purity alumina, $Al_2O_3$) mounted in a reactor vessel over a burner. A refractory screw conveyor driven by a motor external to the reactor vessel moves the gypsum along the tube. Diffusion-resistant gaseous elemental sulfur is fed into the tube through an appropriate port to react, upon contact, with the hot $CaSO_4$ to produce solid calcium sulfide and sulfur dioxide. As the solids are conveyed through the tube by the helix of the screw conveyor, the solid $CaSO_4$ is first contacted with the elemental sulfur to product sulfur dioxide and solid calcium sulfide which is then brought into intimate solid-solid contact with calcium sulfate and reacts therewith to form lime and a further quantity of sulfur dioxide. The resulting lime (CaO) product is conveyed by the auger to a discharge port. The resulting $SO_2$ product, which is relatively free of contaminants, is taken from the vessel via an appropriate outlet.

By isolating the reaction zone within a high thermal conductivity tube in a reactor according to the present invention, the problems associated with product contamination by combustion gases and fines therein are overcome. By using appropriate materials for the tubes and screw conveyor, relatively high thermal efficiencies are possible. The new reactor also provides excellent contact times for reactants in a relatively non-turbulent atmosphere, particularly as compared to prior apparatus in which gas is introduced at high velocity into a reaction zone.

The reactor can be dimensioned to handle a wide range of feedstock solid sizes, from 4inches down to fines, and a wide gradation in feedstock solid sizes. The plug-flow characteristic of the reactor permits precise control of hold-up time and temperature profile to which a solid reactant can be subjected, thus permitting its operational condition to be readily adapted to the requirements needed for most efficient treatment of differing compositions of feedstock solids. Since the combustion gases are maintained external to the solids reaction zone the reactor can be efficiently operated with any type of fuel, producing a clean combustion gas at the reactor exit from which energy may be recovered.

The present invention recognizes and addresses the previously-mentioned long-felt needs and provides a satisfactory meeting of those needs in its various possible embodiments.

DESCRIPTION OF THE DRAWINGS

So that the manner in which the above-recited features and advantages of the invention, as well as others which will become clear, are attained and can be understood in detail, a more particular description of the invention briefly summarized above may be had by reference to certain embodiments thereof which are illustrated in the appended drawings.

DESCRIPTION OF PREFERRED EMBODIMENTS

Figure 1:
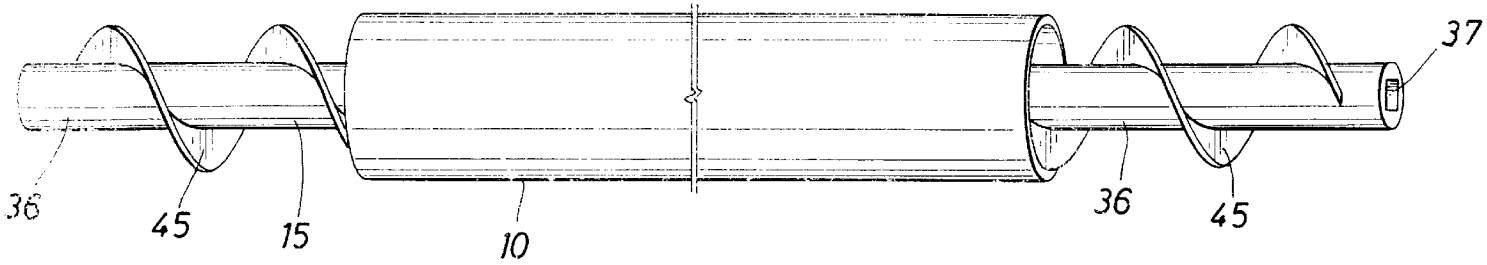
FIG. 1 is a perspective view of a reaction tube through which a solids screw conveyor passes.

With reference to FIG. 1, the essential core element of the reactor of this invention comprises a reaction tube 10 and a screw conveyor 15 mounted within by which solid reactants are propelled by screw rotation through the interior of reaction tube 10. Reaction tube 10 is constructed of a refractory material which has a high thermal conductivity value, preferably of at least about 38 BTU/hr·°F.·ft$^2$/inch at a temperature of 1832° F. (5.7 watt·M$^{-1}$°K.$^{-1}$ at 1000° C.) and most preferably of at least about 60 BTU/hr·°F.·ft$^2$/inch at 1832° F. Suitable refractory materials for construction of reaction tube 10 include graphite, pure dense MgO, pure dense alumina, silicon carbide, beryllia, siliconnitride, and boroncarbide. Due to its high corrosion resistance, maximum service temperature, and strength at high temperature, a high purity dense alumina, such as about 99.5%, is a preferred material for reaction tube construction. Especially preferred is a high purity alumina (99.7%) marketed under the tradename Alsint by W. Haldenwanger Technische Keramik GmbH & Co. KG of Germany.

For technical reasons, in some cases it may not be possible to procure a one-piece tube large enough for the application. In those cases, a reaction tube of the desired diameter and length may be fabricated by conventional procedures known for preparing refractory materials to a desired and dense configuration, for example arc melting-fusion casting or hot pressing. For example, alumina can be slip-cast into tubular section of 1 meter inside diameter and 1 meter long with a lip on its distal end and a groove on its proximal end dimensioned to be congruent to the lip. The number of sections needed to provide a reactor tube of the desired length can then be cemented together in a lip and groove abutting relationship with a refractory cement. Preferably, each joint of a reaction tube when located within a furnace chamber will be supported with brickwork and the brickwork support may be merged into baffle walls which will cause combustion gases within the furnace chamber to pass back and forth across the exterior surface of the reaction tube.

The screw conveyor 15 may be comprised of a central spindle 36 mounted with molded parts carrying the helix or flights 45 made of a refractory of low thermal conductivity, preferably less than about 25 BTU/hr·°F.·ft$^2$/inch at a temperature of 1832° F. Preferably spindle 36 should be constructed of temperature-resistant concrete, reinforced with pieces of alumina rods and/or tubes.

Figure 3:
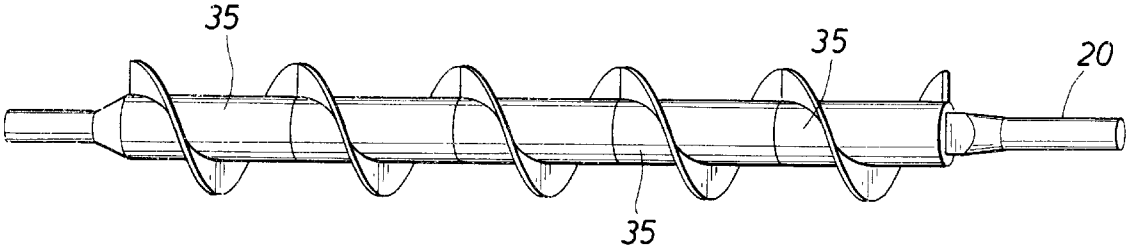
FIG. 3 is a perspective view of screw conveyor comprised of a solid central drive shaft over which are refractory helix flight sections.
Figure 4:
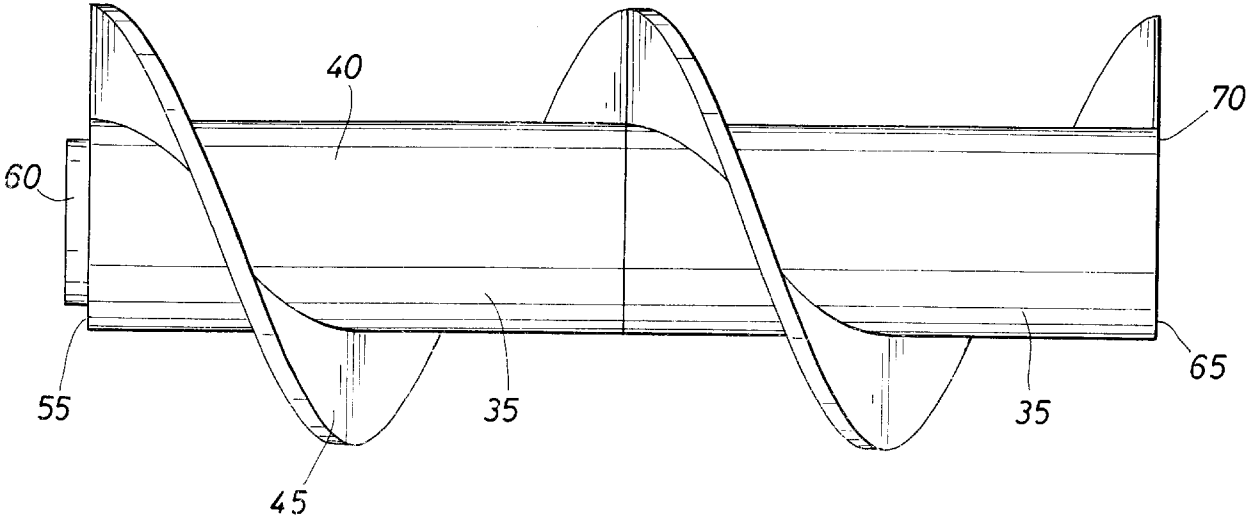
FIG. 4 is an enlarged side view of two refractory flight sections as they are mounted on a central drive shaft.
Figure 5:
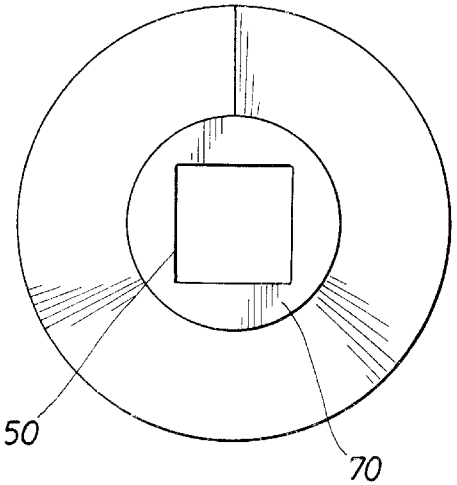
FIG. 5 is an end view of a refractory flight section.

The preferred construction of the screw conveyor is illustrated in FIGS. 3–5. The screw conveyor of FIG. 3 comprises a central concrete shaft 20 reinforced interiorly with alumina rods. The shaft has a square cross-section shape, but its ends are fitted with adaptors that convert the cross-sectional shape to circulars in order to fit standard bearings. Such adaption can be fabricated from a metal such as Alloy 330.

About the exterior of shaft 20 are located molded refractory flight segments 35. As shown in FIGS. 4 and 5, a flight segment 35 is comprised of a hollow central spindle 40 from which screw flights 45 are exteriorly pendant. The hollow center of spindle 40 has a square-shaped cross-section which corresponds to the outside shape of shaft 20 or there may be included an annular space between the spindle 40 and the exterior of shaft 20, so that an extra layer of insulation may be included. The distal end 55 of each spindle 40 is fabricated with a lip 60 and the proximal end 65 is fabricated with a groove 70 of congruent dimensions.

A screw conveyor of the desired dimension is prepared by mounting to center shaft 20 that number of refractory flight sections 35 in a distal end 55 to proximal end 65 abutting arrangement. Where desired the distal end 55 may be fabricated to have a locking lip 60 and the proximal end 65 may be fabricated to have a locking groove 70 whereby abutting segments are locked together through the registration of the locking lip 60 of one with the locking groove 70 of the other, until the desired length of the screw conveyor 15 is achieved. The join lines between ceramic sections may be grouted with a refractory cement, if desired.

The material of which the refractory flight sections are comprised are preferably of low thermal conductivity; at 2400° F. preferably less than about 20 BTU/hr·°F.·ft$^2$/inch. Illustrative, but not limiting, of refractory materials suitable for fabricating the flight sections are mullite, zirconia and Zircar® Type A Moldable Alumina.

Figure 2:
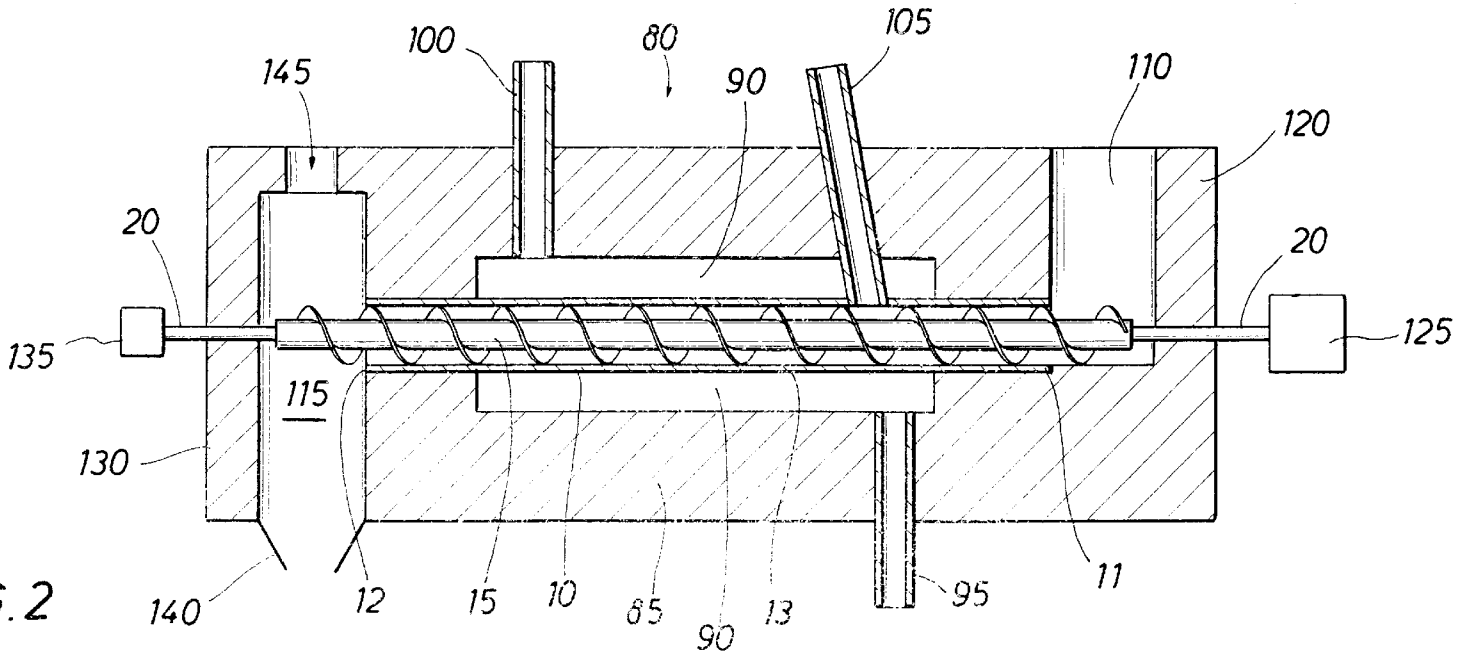
FIG. 2 is a cross-sectional side view of a single tube screw driven reactor wherein the reaction tube is communicated with a reagent addition conduit.

FIG. 2 shows a reaction tube 10 with a screw conveyor 15 mounted therein which are located within a furnace 80. Furnace 80 is constructed of refractory brick and comprises a housing 85 which defines a combustion chamber 90 and a combustion gas admission port 95 and exit port 100 which are in communication with combustion chamber 90. Combustion chamber 90 may contain appropriate tube support and baffling structures which are not illustrated. Of course, the combustion chamber is not needed if hot gases for heating are available from outside the unit. Reaction tube 10 is supported by housing 85 at its distal end 11 and proximal end 12 such that the intermediate portion 13 of reaction tube 10 is sealed within combustion chamber 90 in a gastight reactionship. As further illustrated by the reactor embodiment shown by FIG. 2, a conduit 105 is provided which communicates the interior of the reaction tube 10 to the exterior of the furnace housing. This conduit provides an access to the interior of the reactor tube by which other reagents may be added as desired.

The furnace housing 85 further defines a solids feed bin 119 and a products outlet bin 115. The distal end 11 of tube 10 is located adjacent to and in communication with solids feed bin 110, the proximal end 12 is adjacent to and in communication with products outlet bin 115. Screw 15 extends through the interior of tube 10 such that one or more flights 40 of the screw helix are located within feed bin 110 and outlet bin 115. The distal end of shaft 20 of the screw passes through a journal-seal opening in the distal wall 120 of housing 85 wherein it is coupled to a device for rotating the shaft 125. That length of the screw 15 which extends within feed bin 110 may be fabricated with screw flights of shorter pitch to control the flow of solids into tube 10 so that the load is correctly proportioned for the tube length beyond the feed point. When it is desired to support the lower end of the screw above the floor of the tube, the proximal end of shaft 20 can be passed through a journal-seal opening in the proximal wall 130 of housing 85 as shown.

In operation of the reactor as shown in FIG. 2, solids reactants are supplied to feed bin 110 at a rate to keep the flights of screw 15 covered. Hot gases from a burner or other source (not illustrated) are admitted to combustion chamber 90 through admission port 95 and spent gases exit the chamber by port 100 and may be treated for waste heat recovery or used for generation of electricity by conventional means (not illustrated) without need for further treatment. Rotation device 125 rotates the screw conveyor 15 which in turn feeds solids in bin 110 along the helix of the screw into and through reaction tube 10 wherein the solids undergo reaction as they pass through the interior of the tube towards the product discharge bin 115. Wherein the nature of the intended reaction requires the presence of another reagent in addition to the solid reactant; such reagent is admitted to the interior of the reaction tube 10 through conduit 105. The products of reaction are discharged by the rotation of screw 15 into the products discharge bin 115 wherein solid reaction products fall by gravity to the bottom portion of the bin for discharge through chute 140 to a holding area. Gaseous reaction products are withdrawn from bin 115 through port 145 and may be routed to other means (not illustrated) for storage, further treatment, or disposal.

A reactor as illustrated in FIG. 2 is particularly well suited for accomplishing the reduction of gypsum to lime and sulfur dioxide by reaction thereof with elemental sulfur in the form of a coherent diffusion resistant gas which is prepared in the manner described by U.S. Pat. No. 4,520,002.

Figure 6:
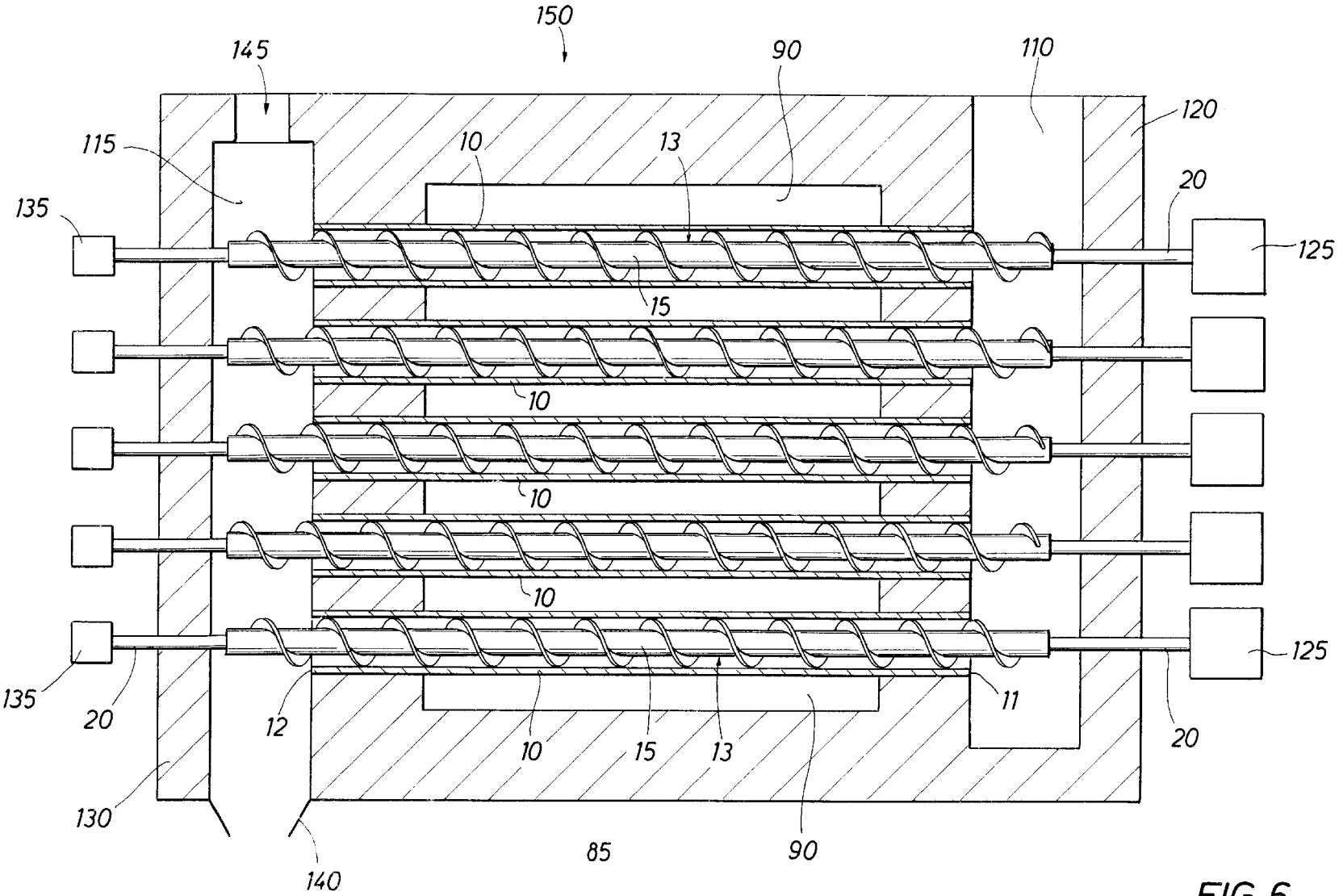
FIG. 6 is a cross-sectional view of a multiple tube screw driven reactor.

Referring now to FIG. 6, a reactor system 150 according to the present invention comprises a spaced apart plurality of screw driven reaction tubes 10 located within a combustion chamber 90 of a furnace housing 85. The multiple tubes may be arranged in ranks, files, rank and file, or in a staggered arrangement. The other features of the furnace housing 85 and associated elements are similar to those described for the reactor of FIG. 2. For purposes of clarity the admission conduit 105 by which other reagents may be fed to the interior of one or more of the multiple reaction tubes has not been illustrated in FIG. 6; but it will be appreciated that a reactor system can be constructed to have such admission tubes. Further not illustrated in FIG. 6 are the ports 95 and 100 by which hot gases from a burner or other source are admitted to or taken from combustion chamber 90.

Figure 7:
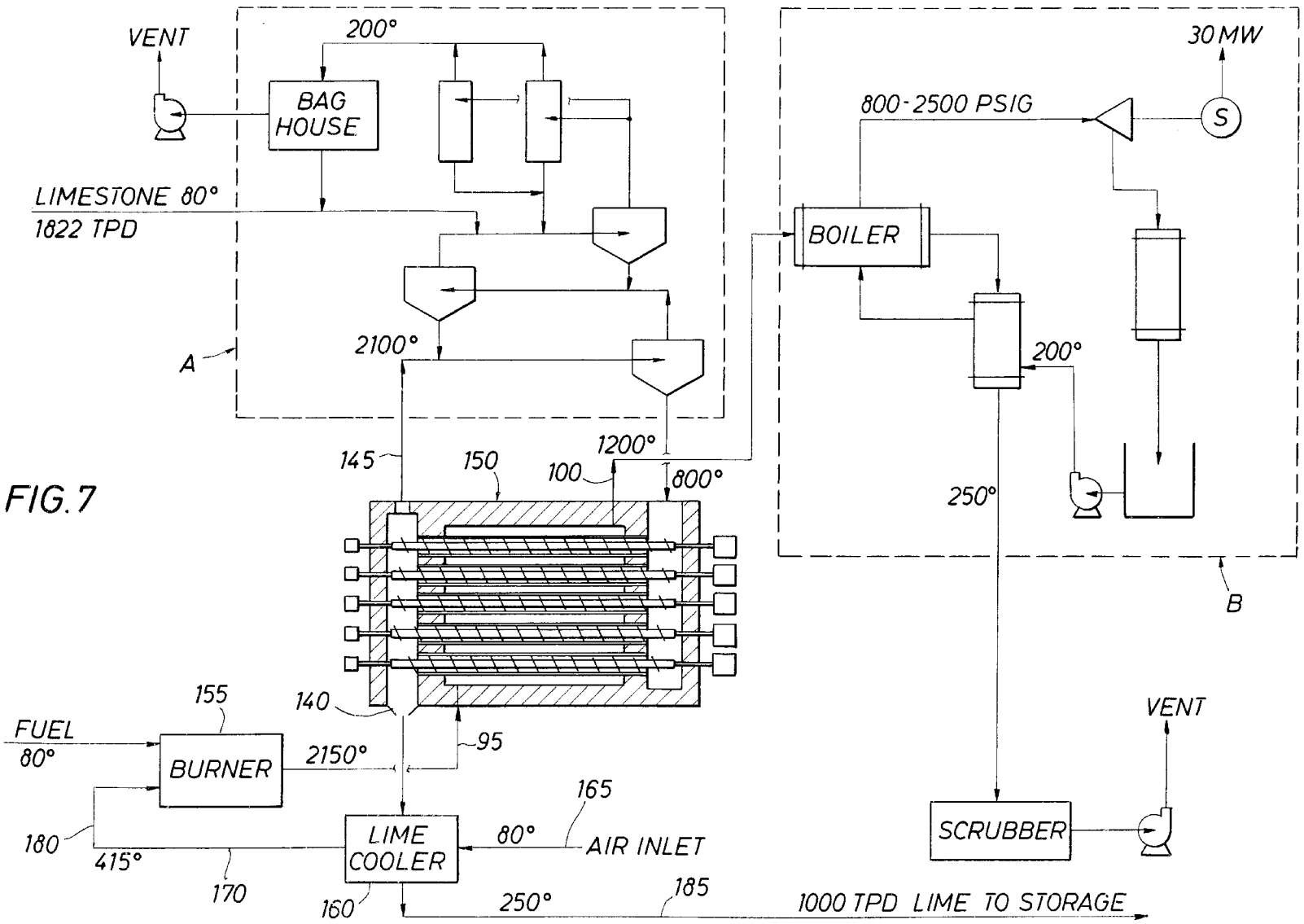
FIG. 7 is a schematic plan depicting the employment of a multiple tube screw driven reactor for the production of lime from limestone.

With reference to FIG. 7, a process is schematically depicted for the production of lime from limestone which employs a reactor system 150 as illustrated in FIG. 6. In the process burner 155 supplies combustion gases at 2150° F. through line 95 to the combustion chamber of reactor system 150. Limestone, which is dried and preheated by contact with hot product gases ($CO_2$) taken from reactor system 150 by line 145 and routed to an intercommunicated series of drying and feeder hoppers, illustrated as block A is fed therefrom at about 800° F. to the feed bin of the reactor system 150. By rotation of the screw of each tube limestone is fed from the feed bin into and through each tube. Spent combustion gases are taken from the reactor system by line 100 and directed to an electricity cogeneration unit, illustrated by block B of FIG. 7, which may comprise a steam boiler, steam driven generator, condenser and condensate recycle pump and conduits. Lime product solids are discharged from reactor system 150 through the discharge chute 140 to a lime cooler 160. Ambient temperature air is passed by line 165 into lime cooler 160 to cool the hot lime product and become heated air which is taken from lime cooler 160 by line 170. Cooled lime product is conveyed by line 185 to a lime storage container.

EXAMPLE

Limestone preheated to 800° F. is fed into the reactor screw feed trough, where it is picked up and carried through a reactor similar to that shown in FIG. 2 by the variable speed conveying screw. Atmospheric air is supplied by a blower with a discharge pressure of about 30" water column and preheated by exchange with the exit combustion gases before entering the burner. Natural gas is controlled by a temperature indicating controller (TIC) set for the desired inlet gas temperature. The combustion gases pass back and forth across the tube by brick partitions which divide the shell side into six sections, and then exhausts to the air through the combustion air preheater. At the product end of the reactor, the product solids fall through an aluminum foil shroud into a container that sits on a scale. The tube-side gases are drawn off through a jet-eductor using potassium hydroxide as motive fluid, and then they are scrubbed again with KOH in a packed-column secondary scrubber before being exhausted to the atmosphere.

The screw was covered with a ¼" thickness of moldable alumina (Type A Moldable Refractory Sheet—Zircar Products, Inc., Florida, New York). The screw is installed in the reactor and heated to about 1200° F. while turning at about 2 min/rev. It is then allowed to cool and then is painted with several liberal coats of Zircar Type AL-Hard Rigidizer/Hardener. Then it is put back into the reactor and run through this cycle one more time.

The limestone feed material as received was passed through a 20-mesh screen, and the +20 material (about 10–20% of the total) was rejected—except that unscreened material was fed for the last hour of phase 5 to see if any physical or chemical differences were observed.

Trial #1 investigated the dissociation of limestone under comparatively mild conditions of exposure to temperature and retention time in the reactor, while Trial #2 investigated the most extreme conditions required for full dissociation of calcium carbonate ($CaCO_3$) in the reactor. In Trial #1, the holdup time was set at 4 min/section (1 minute, 20 seconds per revolution of the screw) and the inlet temperature was held at 1950° for phase 1-1 of this trial. After about 2 hours of operation the inlet temperature was raised to 2060° for phase 1-2. These conditions were held for about 3 more hours, until the limestone had all been fed, and this ended trial #1. Another larger batch of limestone feed material was procured for trial #2 which began with phase 2-1, an hour's operation near the same conditions as applied in phase 1-2 of trial 1. Screw speed was then allowed to provide 6 min/section hold-up time (2 minutes per revolution) while the inlet temperature was continued holding at 2050° for phase 2-2. The temperature was then increased in 50° increments successively for phases 2-3, 2-4, and 2-5 of trial #2.

All feed and product samples were tested for Loss on Ignition (LOI) and % Available Lime (A.L.).

It was not possible to obtain samples along the length of the reactor tube, and thus to see the variation in time of the concentration of reactant. Therefore, the standard methods of reaction rate analysis based on the Arrhenius equation are precluded. A comparative method which compares the degrees of exposure in time and temperature required for full decomposition of the $CaCO_3$ in the reactor with those needed by other types of equipment was employed.

In this method, the temperature profile of the combustion gases on the shell side of the reactor is plotted, and the temperature of the solids is assumed to follow this same profile. Then, since the rate of solids progress through the tube is set, the time spent above the 1648° theoretical dissociation temperature can be determined. A triangular area is formed on the plot, with the base being 1648°, the height is the difference between the maximum temperature and 1648°, and the hypotenuse is the gas temperature profile. The area of this triangle is taken to be an "exposure factor" that can be used in conjunction with product analyses to relate the degree of "exposure" in the reactor to the degree of dissociation attained. This provides a basis of comparison between different combinations of temperature profile and holdup, different feedstocks, etc. Since the temperature profiles and holdup times in other types of kilns can be estimated from available data, the method can also be used to make comparisons with processes using such other equipment.

Figure 8:
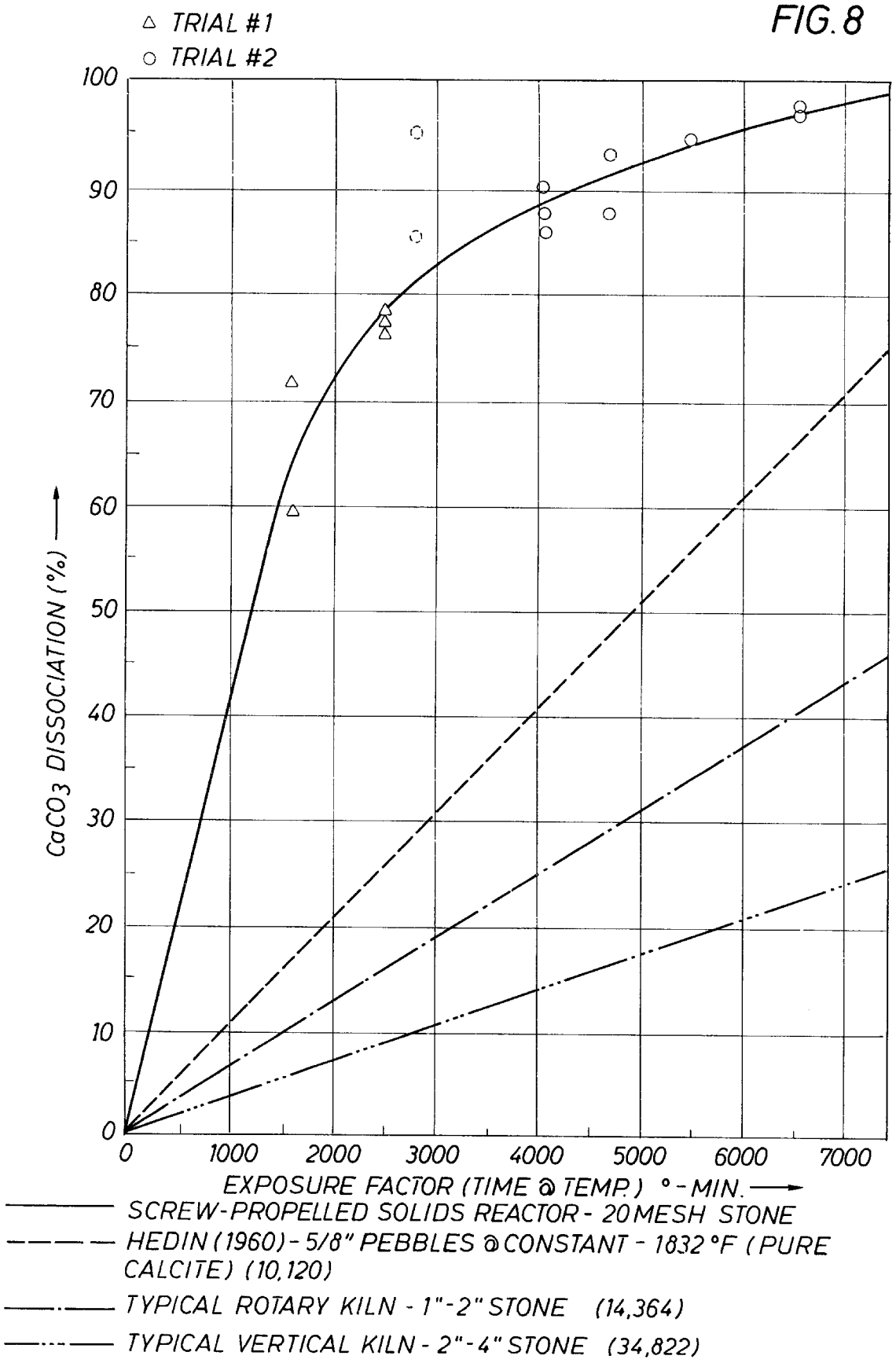
FIG. 8 is a graph which plots the degree of limestone dissociation versus an exposure factor as described in the Example in comparison to that which may be calculated for other types of conventional kilns.

The data from both trials are shown in FIG. 8, along with comparable curves for other laboratory and commercial dissociations estimated from the literature. It can be seen that the reactor accomplishes nearly complete dissociation with a great deal less exposure than is required by any of the other methods. Such an advantage is important not only in holding down capital costs, but also in assuring the highest quality lime product. It is believed that the experimental curve breaks over above about 80% dissociation due to the very high level of impurities in the feed (see below), so that full dissociation of high-grade limestone might well be reached with even less exposure. FIG. 9 shows that the reactor is quite effective for the purpose of dissociating limestone.

It is a rule of thumb in the lime industry that impurities in the stone will cause about a four-fold reduction in available lime content in the product. The loss of $CO_2$ will approximately double the percentage of impurities in the solids phase, and the reaction of impurities with lime to give non-available forms of CaO will just about double it again. That is, the approximately 12% impurities in the feed (8% in Trial 1; 13% in Trial 2) would give about 24% impurities in the dissociated solids, and the lime-silica reactions would double that to about 48% impurities in the lime product, leaving about 52% available lime as the maximum that can be achieved from that feed material. The average available lime content of the product in phase 2-5 of trial #2 was 51.3% which is reasonable agreement with the rule of thumb.

From this description of the preferred embodiments of the invention those of ordinary skill in the art may appreciate that certain modifications may be made therein which do not depart in scope or spirit from the invention as described above or claimed hereafter.

I claim:

1. An indirect-fired furnace reactor comprising:

a furnace housing which defines a combustion chamber, a solids feed bin and a product discharge bin;

a reaction tube having an interior and an exterior, a distal end located adjacent to and communicating the tube interior with the solids feed bin and a proximal end adjacent to and communicating the tube interior with the product discharge bin, said distal and proximal ends being supported by the furnace housing to seal the tube exterior within said combustion chamber in a gas tight relationship; wherein the reaction tube is fabricated of a refractory material, wherein said refractory material has a thermal conductivity of at least about 38 BTU/hr·°F.·ft$^2$/inch at 1832° F.;

at least one reaction tube support between the reaction tube distal end and the reaction tube proximal end;

a screw conveyor having an exterior surface within the tube interior;

a driving device for rotating the screw conveyor; and a heat source for supplying heat into the combustion chamber.

2. The reactor of claim 1, wherein the screw conveyor exterior is comprised of a second refractory material having a thermal conductivity of less than 25 BTU/hr·°F.·ft$^2$/inch at 1832° F.

3. The reactor of claim 2, wherein the tube is comprised of alumina of a purity of at least about 99.5%.

4. The reactor of claim 3, wherein the screw conveyor exterior is comprised of mullite.

5. The reactor of claim 1, wherein at least one flight of the screw conveyor is positioned within the feed bin and the product bin.

6. An indirect-fired furnace reactor comprising:

a furnace housing which defines a combustion chamber, a solids feed bin and a product discharge bin;

a reaction tube having an interior and an exterior, a distal end located adjacent to and communicating the tube interior with the solids feed bin and a proximal end adjacent to and communicating the tube interior with the product discharge bin, said distal and proximal ends being supported by the furnace housing to seal the tube exterior within said combustion chamber in a gas tight relationship, a screw conveyor having an exterior surface within the tube interior, wherein the screw conveyor exterior is comprised of a refractory material having a thermal conductivity of less than 25 BTU/hr·°F.·ft$^2$/inch at 1832° F.;

a driving device for rotating the screw conveyor;

a conduit which communicates the tube interior to an area external to the combustion chamber;

means for generating coherent diffusion resistant elemental sulfur which is in communication with the conduit; and a heat source for supplying heat into the combustion chamber.

7. The reactor of claim 6, wherein the reaction tube is comprised of alumina of a purity of at least about 99.7%.

8. The reactor of claim 7, wherein the screw conveyor is comprised of mullite.

9. A method for producing a solid product from a solid reactant comprising:

providing a reaction tube fabricated of a refractory material having a distal end located adjacent to and communicating a tube interior with a solids feed bin and a proximal end adjacent to and communicating the tube interior with a product discharge bin, said distal and proximal ends being supported by a furnace housing to seal an exterior surface of the tube within a combustion chamber in a gastight relationship;

providing at least one reaction tube support between the reaction tube distal end and the reaction tube proximal end;

passing a solid reactant into the tube interior, said solid reactant selected from the group consisting of mineral ores, metallic halides, metallic carbides, metallic carbonates, metallic oxides, metallic phosphates, metallic sulfides and metallic sulfates;

moving the solid reactant through the tube interior by rotating a screw conveyor within the tube interior; and heating the exterior surface of the tube to a temperature required for reaction of the solid reactant to produce the solid product during the passage of the solid reactant through the tube.

10. The method of claim 9, wherein the solid reactant is limestone and the solid product is lime.

11. The method of claim 10, wherein the tube exterior is heated to at least about 2,150° F.

12. The method of claim 9, wherein said refractory material has a thermal conductivity of at least about 38 BTU/hr·°F.·ft$^2$/inch at 1832° F.

13. A method for producing a solid product from gypsum comprising:

passing $CaSO_4$ into an interior area of a reaction tube having a distal end located adjacent to and communicating the tube interior with a solids feed bin and a proximal end adjacent to and communicating the tube interior with a product discharge bin, said distal and proximal ends being supported by a furnace housing to seal an exterior surface of the tube within a combustion chamber in a gastight relationship, moving the $CaSO_4$ through the tube by rotating a screw conveyor within the interior of the tube; and supplying to the interior of the reaction tube coherent diffusion resistant elemental sulfur gas while heating the exterior of the tube to a temperature of at least about 1832° F. during the passage of the $CaSO_4$ through the tube.

14. An indirect-fired all ceramic furnace reactor comprising:

a furnace housing which defines a combustion chamber, a solids feed bin and a product discharge bin;

a spaced apart plurality of reaction tubes, each of said tubes having an interior and an exterior, a distal end located adjacent to and communicating said tube interior with said solids feed bin and a proximal end adjacent to and communicating said tube interior with said product discharge bin, said distal and proximal ends being supported by said furnace housing to seal said tube exterior within said combustion chamber in a gas tight relationship, wherein each of said reaction tubes is fabricated of a refractory material, wherein said refractory material has a thermal conductivity of at least about 38 BTU/hr·°F.·ft$^2$/inch at 1832° F.;

at least one reaction tube support for each of said reaction tubes between said reaction tube distal end and said reaction tube proximal end;

a screw conveyor for each of said reaction tubes having an exterior surface within said tube interior;

a driving device for each of said reaction tubes for rotating said screw conveyor; and a heat source for supplying heat into the combustion chamber.

15. The reactor of claim 14, wherein said screw conveyor exterior is comprised of a second refractory material having a thermal conductivity of less than 25 BTU/hr·°F.·ft$^2$/inch at 1832° F.

16. The reactor of claim 14, wherein said tubes are arranged in ranks.

17. The reactor of claim 14, wherein said tubes are arranges in files.

18. The reactor of claim 14, wherein said tubes are arranged in a combination of ranks and files.

19. The reactor of claim 14, wherein said tubes are in a staggered arrangement.

* * * * *